US009691543B2

(12) United States Patent
Kumar et al.

(10) Patent No.: US 9,691,543 B2
(45) Date of Patent: Jun. 27, 2017

(54) HIGH VOLTAGE TRANSFORMER ARRANGEMENT FOR HIGH VOLTAGE TANK ASSEMBLY

(71) Applicant: General Electric Company, Schenectady, NY (US)

(72) Inventors: Niranjan Kumar, Karnatka (IN); Dennis Perrillat-Amede, Paris (FR); Venugopal Vadivel, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 130 days.

(21) Appl. No.: 14/552,857

(22) Filed: Nov. 25, 2014

(65) Prior Publication Data

US 2015/0145344 A1 May 28, 2015

(30) Foreign Application Priority Data

Nov. 28, 2013 (IN) ..... 5486/CHE/2013

(51) Int. Cl.

| | |
|---|---|
| ***H01F 27/00*** | (2006.01) |
| ***H01F 27/32*** | (2006.01) |
| ***H01F 27/02*** | (2006.01) |
| *H01F 38/14* | (2006.01) |

(52) U.S. Cl.

CPC ..... *H01F 27/324* (2013.01); *H01F 27/00* (2013.01); *H01F 27/02* (2013.01); *H01F 27/022* (2013.01); *H01F 38/14* (2013.01); *Y10T 29/49073* (2015.01)

(58) Field of Classification Search

CPC ..... H01F 27/00–27/30
USPC ..... 336/55–62
See application file for complete search history.

(56) References Cited

U.S. PATENT DOCUMENTS

| | | | | |
|---|---|---|---|---|
| 3,549,990 | A * | 12/1970 | Hochheiser | H01F 27/40 323/345 |
| 4,956,745 | A * | 9/1990 | Burgher | H01F 27/40 307/150 |
| 5,923,723 | A * | 7/1999 | Herbst | H05G 1/06 378/101 |
| 2002/0060918 | A1 * | 5/2002 | Drobnik | G06F 1/26 363/68 |

* cited by examiner

*Primary Examiner* — Tuyen Nguyen
(74) *Attorney, Agent, or Firm* — GE Global Patent Operations; Marc A. Vivenzio

(57) ABSTRACT

A high voltage transformer arrangement for supplying power to a high voltage tank assembly is disclosed. The high voltage transformer arrangement includes a first core arranged in the high voltage tank assembly and a secondary winding configured on the first core, a second core positioned outside of the high voltage tank assembly and at a predefined distance from the first core, and a primary winding configured on the second core. The second core and the primary winding transfers current received from an external power source to the first core and secondary winding for supplying power to the high voltage tank assembly.

14 Claims, 3 Drawing Sheets

HIGH VOLTAGE TRANSFORMER ARRANGEMENT FOR HIGH VOLTAGE TANK ASSEMBLY

TECHNICAL FIELD

The subject matter disclosed herein relates to high-voltage transformers and more specifically those implemented in high-voltage power supplies, in particular those implemented in medical imaging devices and more specifically power supplies for X-ray tubes of such devices.

BACKGROUND OF THE INVENTION

High-voltage power generation systems are used for, for example, supplying regulated high-voltage direct current (DC) to multiple devices. The power generation system typically includes a transformer unit which has a high secondary-to-primary turns ratio and converts a relatively low-voltage alternating current (AC) to a relative high-frequency and high-voltage AC. The power generation system may further include a voltage doubler or voltage multiplier module which utilizes a plurality of capacitors and diodes to further boost the high-voltage AC from the secondary windings of the transformer module, as well as to convert the high-voltage AC into the targeted high-voltage DC.

Generally a high voltage (HV) tank assembly comprises a voltage rectifier circuit and a transformer assembly (i.e. a high voltage transformer) coupled to the voltage rectifier circuit. The voltage rectifier circuit and the transformer assembly are among bulky modules of the radiation generator. The high voltage (HV) transformer is a larger component in the HV tank assembly and may require HV insulation. The HV transformer may also need to dissipate heat which are losses i.e. core loss, copper loss and dielectric loss. Due to heat losses cooling arrangements may be required that renders the transformer assembly bulky. Further for power generation a power source needs to be connected to the HV tank assembly through the HV transformer which also makes the assembly complex and bulky. These power sources are high and medium voltage type sources. The power sources are connected to the HV transformer through expensive electrical connectors such as metal connectors that may be subject to vibration and corrosion over a period of time. Moreover they are also prone to mechanical stress resulting in unexpected failure of these connectors thereby breaking down the HV transformer.

Therefore there is a need for an improved system for supplying electric current to the HV transformer for generating power for the HV tank assembly.

BRIEF DESCRIPTION OF THE INVENTION

The above-mentioned shortcomings, disadvantages and problems are addressed herein which will be understood by reading and understanding the following specification.

In an embodiment a high voltage transformer arrangement for supplying power to a high voltage tank assembly is disclosed. The high voltage transformer arrangement includes a first core arranged in the high voltage tank assembly and a secondary winding configured on the first core, a second core positioned outside of the high voltage tank assembly and at a predefined distance from the first core, and a primary winding configured on the second core. The second core and the primary winding transfers current received from an external power source to the first core and secondary winding for supplying power to the high voltage tank assembly.

In another embodiment a high voltage tank assembly for generating power is disclosed. The high voltage tank assembly includes a fluid tank and one or more high voltage transformer arrangements. Each high voltage transformer arrangement includes a first core arranged in the high voltage tank assembly, a secondary winding configured on the first core, a second core positioned outside of the high voltage tank and at a predefined distance from the first core; and a primary winding configured on the second core. The second core and the primary winding transfers current received from an external power source to the first core and secondary winding for supplying power to the high voltage tank assembly.

In yet another embodiment method of assembling a high voltage transformer arrangement in a high voltage tank assembly. The method comprises arranging a first core at a base portion of the high voltage tank assembly; providing a secondary winding arranged on the first core; arranging a second core outside of the high voltage tank assembly and at a predefined distance from the first core; and providing a primary winding on the second core, wherein the second core and the primary winding transfers current received from an external power source to the first core and secondary winding for supplying power to the high voltage tank assembly.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

As discussed in detail below, embodiments of the invention including a high voltage transformer arrangement for supplying power to a high voltage tank assembly is disclosed. The high voltage transformer arrangement includes a first core arranged in the high voltage tank assembly and a secondary winding configured on the first core, a second core positioned outside of the high voltage tank assembly and at a predefined distance from the first core, and a primary winding configured on the second core. The second core and the primary winding transfers current received from an external power source to the first core and secondary winding for supplying power to the high voltage tank assembly.

Figure 1:
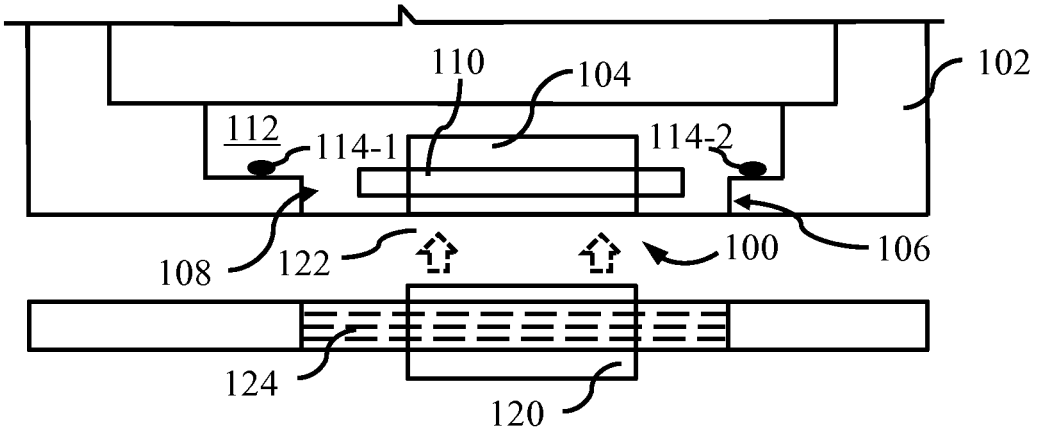
FIG. 1 is a schematic diagram of a high voltage (HV) transformer arrangement for supplying power to a high voltage (HV) tank assembly in accordance with an embodiment.

FIG. 1 is a schematic diagram of a high voltage (HV) transformer arrangement 100 for supplying power to a high voltage (HV) tank assembly 102 in accordance with an embodiment. The HV tank assembly 102 may include fluid such as but not limited to oil, gas and semiliquid fuel. The HV transformer arrangement 100 includes a first core 104 arranged in the HV tank assembly 102. The first core 104 is positioned at a base portion 106 of the HV tank assembly 102. The HV tank assembly 102 includes a slot 108 for positioning the first core 104. The cross-section of the slot 108 as illustrated in FIG. 1 is according to an embodiment and it may be appreciated that the slot 108 may have different structural configuration and this different cross-section. A secondary winding 110 is configured on the first core 104. The secondary winding 110 may be a wound around the first core 104. In another embodiment the secondary winding 110 may be configured in the form of a printer circuit board (PCB) and positioned with respect to the first core 104. It may be appreciated that the secondary winding 110 may be configured in any other manner other than being wound around the first core 104 and as the PCB. A molded component 112 is positioned covering the first core 104 and the secondary winding 110 to securely place them in the slot 108. The molded component 112 may be composed of a molding material. The molded material may be for example epoxy resin and filled epoxy resin. The molded component 112 may be connected to the base portion 106 using one or more fastening members such as a fastening member 114-1 and a fastening member 114-2. In an embodiment the molded component 112 may be fastened to the base portion 106 using one or more mechanical joints or mechanical connectors. In another embodiment the molded component 112 may be soldered to the base portion 106. Other forms of mechanical or other connectors may be used to position the molded component 112 connected to the base portion 106. The molded component 112 also ensures that there is no leakage of fluid from the HV tank assembly 102.

Figure 2:
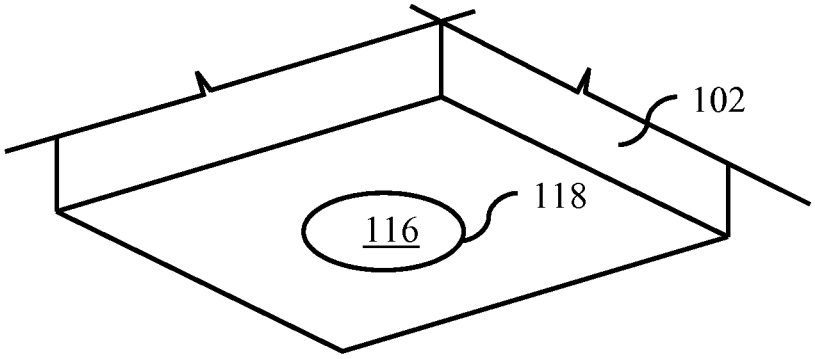
FIG. 2 is a schematic illustration of a base portion of the HV tank assembly in accordance with an embodiment.

A portion 116 of the first core 104 is exposed out of the HV tank assembly 102. The HV tank assembly 102 includes an opening 118 for exposing the portion 116 as illustrated in FIG. 2 in accordance with an exemplary embodiment. The opening 118 is shown to be circular in shape as an exemplary representation and hence it may be envisioned that an opening for exposing the first core 104 may have any other shape based on the shape of the first core 104. In another exemplary embodiment the opening may be configured in form of a slot for securely holding a first core in place and to expose of a portion of the first core outside a HV tank assembly. These are exemplary configurations of the opening (e.g. the opening 118) and thus it may be envisioned that other configurations of the openings may be used in the HV transformer arrangement 100.

The HV transformer arrangement 100 includes a second core 120 positioned at a predefined distance from the portion 116 of the first core 104. As shown in FIG. 1 a gap 122 is present between the portion 116 and the second core 120. The second core 120 has a primary winding 124 configured on it. The primary winding 124 may be a wound around the second core 120. In another embodiment the primary winding 124 may be configured in the form of a printer circuit board (PCB) and positioned with respect to the second core 120 as illustrated in FIG. 2. It may be appreciated that the primary winding 124 may be configured in any other manner other than being wound around the second core 120 and as the PCB. A power source (now shown in FIGs) is provided to supply electric power (i.e. alternate current (AC)) to the primary winding 124 for generating a magnetic field in the gap 122 and magnetic flux in both the cores i.e. the first core 104 and the second core 118. The magnetic flux induces a varying voltage in the secondary winding 110. Thus the power is generated and supplied to the HV tank assembly 102. As described the second core 120 and primary winding 124 are positioned at a distance from the first core 104 and there is no physical or electrical connection between these cores which renders the HV transformer arrangement 100 less complex. Further as there are no electrical or physical connections there is no failure of the transformer arrangement due to corrosion or mechanical stresses at the electrical connections.

Figure 3:
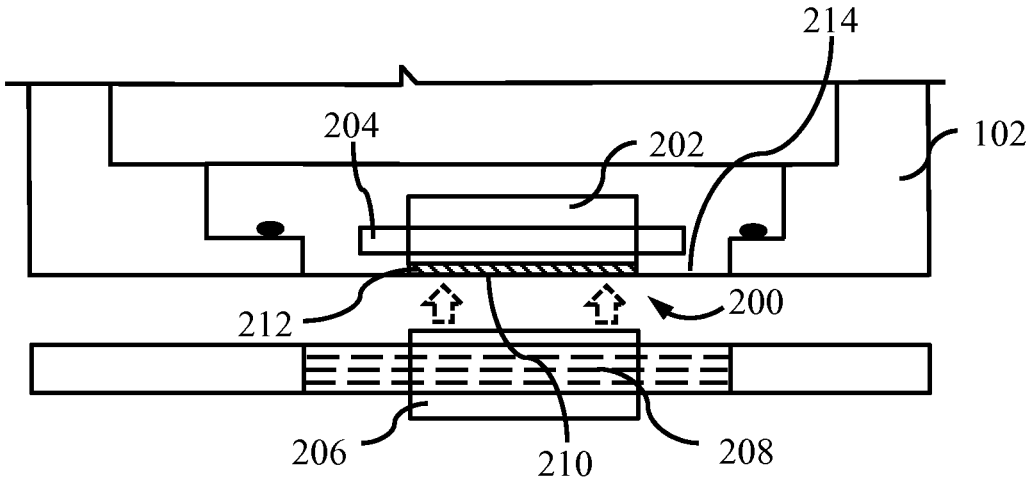
FIG. 3 is a schematic representation of a high voltage (HV) transformer arrangement for supplying power to a high voltage (HV) tank with direct current (DC) isolation in accordance with an embodiment.

FIG. 3 illustrates a schematic diagram of a high voltage (HV) transformer arrangement 200 for supplying power to a high voltage (HV) tank 102 with direct current (DC) isolation in accordance with an embodiment. The structural and constructional arrangement of the HV transformer 200 is similar to the HV transformer 100 and thus a first core 202, a secondary winding 204, a second core 206, a primary winding 208 and an opening 210 are similar to the first core 104, the secondary winding 110, the second core 120, the primary winding 124 and the opening 118 respectively are structurally similar and hence not again explained in detail. A DC isolation layer 212 is provided between the first core 202 and a base portion 214 of the HV tank assembly 102. The DC isolation layer 212 may be positioned on a bottom portion of the first core 202 that aligns with the opening 210. Thus the bottom portion of the first core 202 is not exposed out of the HV tank assembly 102. The DC isolation layer 212 prevents any DC current from the HV tank assembly 102 to flow into the secondary winding 204. The DC isolation layer 212 may be composed of a conductive material that allows the magnetic flux to be generated in the first core 202 due to the magnetic flux generated in the second core 206. The conductive material of the DC isolation layer 212 may include for example but not limited to epoxy resin and filled epoxy resin.

Figure 4:
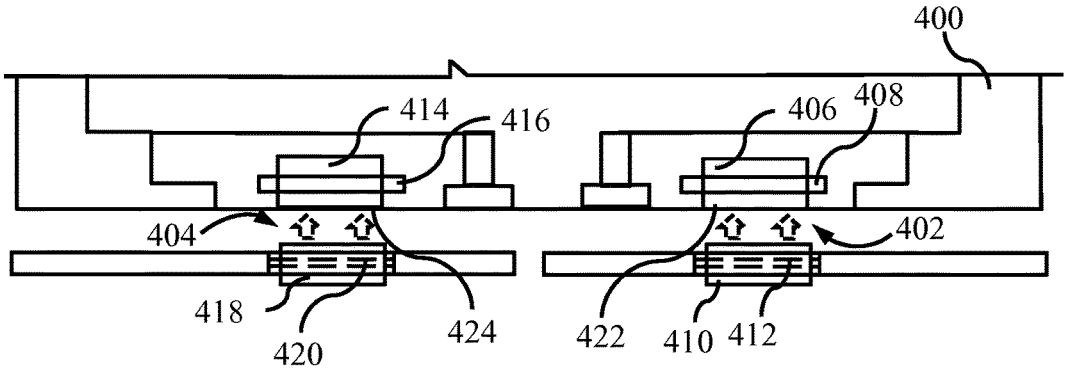
FIG. 4 is a schematic illustration of a HV tank assembly with multiple HV transformer arrangements in accordance with an exemplary embodiment.

The HV tank assembly may have multiple HV transformer arrangements to supply electric power to the HV tank assembly. FIG. 4 is a schematic illustration of a HV tank assembly 400 with multiple HV transformer arrangements such as a HV transformer arrangement 402 and a HV transformer arrangement 404 in accordance with an exemplary embodiment. The HV transformer arrangements 402 and 404 are structurally similar to the HV transformer arrangement 100. The HV transformer arrangement 402 includes a first core 406, a secondary winding 408, a second core 410, and a primary winding 412 similar to the first core 104, the secondary winding 110, the second core 120, and the primary winding 124 respectively. Further the HV transformer arrangement 404 includes a first core 414, a secondary winding 416, a second core 418, and a primary winding 420 similar to the first core 104, the secondary winding 110, the second core 118, and the primary winding 122 respectively. Further openings 422 and 424 may be similar to the opening 116. The primary winding 412 and the primary winding 420 may be in the form of PCB as shown in FIG. 4. One or more power sources (not shown in FIG. 4) may supply AC power to the primary winding 412 and the primary winding 420 to generate the DC power in the HV transformer arrangement 402 and the HV transformer arrangement 404.

Figure 5:
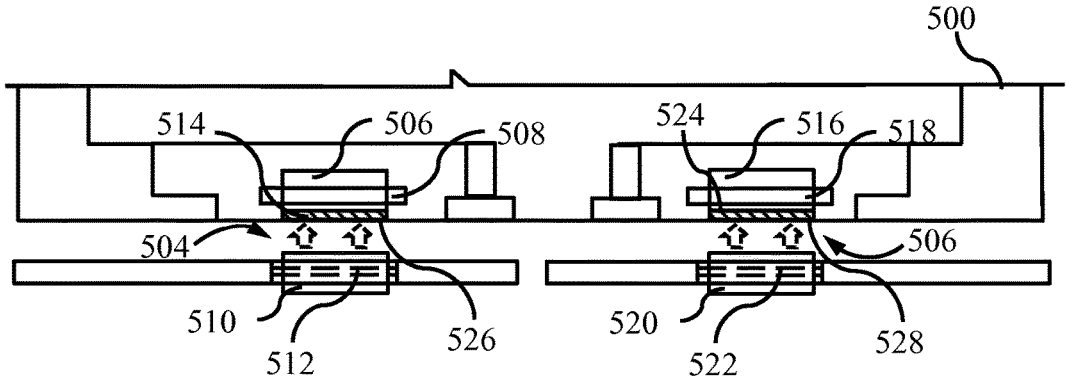
FIG. 5 is a schematic illustration of a HV tank assembly with another type of HV transformer arrangement in accordance with an exemplary embodiment.

FIG. 5 is a schematic illustration of a HV tank assembly 500 with another type of HV transformer arrangement such as a HV transformer arrangement 502 and a HV transformer arrangement 504 in accordance with an exemplary embodiment. The HV transformer arrangement 502 includes a first core 506, a secondary winding 508, a second core 510, a primary winding 512 and a DC isolation layer 514 similar to the first core 202, the secondary winding 204, the second core 206, the primary winding 208 and the DC isolation layer 212 of the HV transformer arrangement 200 respectively. The HV transformer arrangement 504 includes a first core 516, a secondary winding 518, a second core 520, a primary winding 522 and a DC isolation layer 524 similar to the first core 202, the secondary winding 204, the second core 206, the primary winding 208 and the DC isolation layer 212 of the HV transformer arrangement 200 respectively. All the components of the HV transformer arrangements 502 and 504 are functionally similar to the components of the HV transformer arrangement 200 and hence the function of these components is not again explained in detail. Further openings 526 and 528 are similar to the opening 210 of the HV transformer arrangement 200. One or more power sources (not shown in FIG. 5) may supply AC power to the primary winding 512 and the primary winding 522 to generate the DC power in the HV transformer arrangement 402 and the HV transformer arrangement 404.

Figure 6:
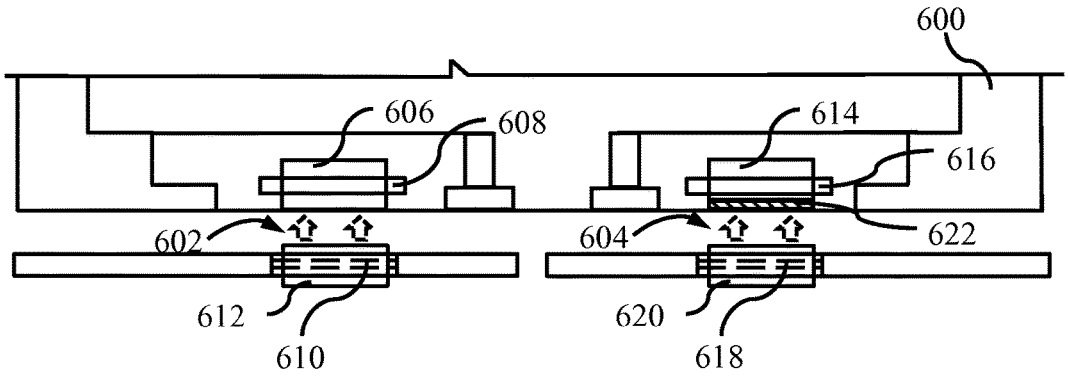
FIG. 6 is a schematic illustration of a HV tank assembly including different types of HV transformer arrangements in accordance with an embodiment.

In yet another exemplary embodiment, a schematic illustration of a HV tank assembly 600 including different types of HV transformer arrangements is shown in FIG. 6. The HV tank assembly 600 includes a HV transformer arrangement 602 and a HV transformer arrangement 604. The HV transformer arrangement 602 includes a first core 606, a secondary winding 608, a second core 610, and a primary winding 612 similar to the first core 406, the secondary winding 408, the second core 410, and the primary winding 412 of the HV transformer arrangement 402 respectively. Further the HV transformer arrangement 604 includes a first core 614, a secondary winding 616, a second core 618, a primary winding 620 and a DC isolation layer 622 similar to the first core 202, the secondary winding 204, the second core 206, the primary winding 208 and the DC isolation layer 212 of the HV transformer arrangement 200 respectively. Thus different types of HV transformer arrangements with and/or without DC isolation layer may be configured within the HV tank assembly in different combinations based on power requirements in the HV tank assembly. One or more power sources (not shown in FIG. 6) may supply AC power to the primary winding 612 and the primary winding 620 to generate the DC power in the HV transformer arrangement 602 and the HV transformer arrangement 604.

The HV tank assembly (such as the HV tank assemblies 102, 200, 400, 500 and 600) is used in various applications such as medical imaging systems, X-ray devices, radiation generators, non-destructive testing and security (e.g. luggage checking) etc.

Figure 7:
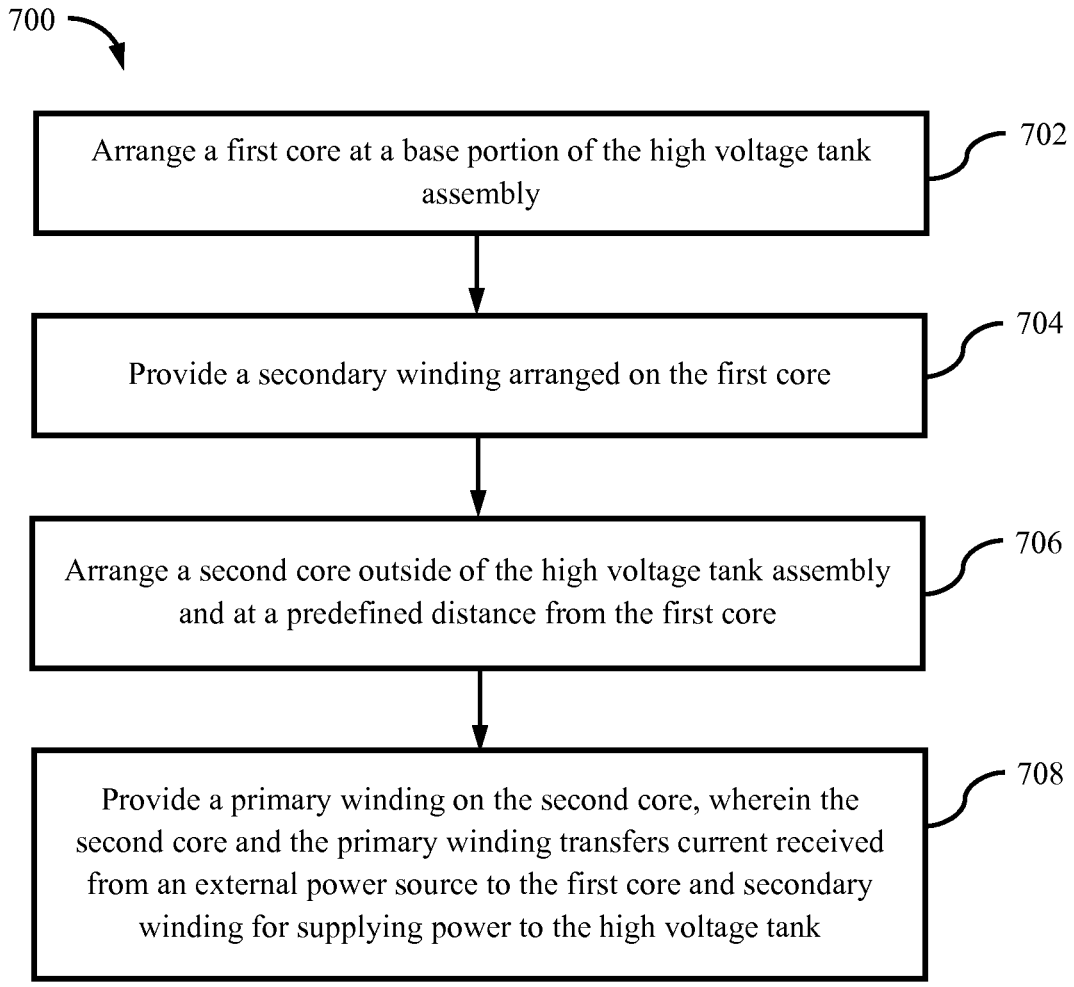
FIG. 7 is a method of assembling a high voltage transformer arrangement in a high voltage tank assembly in accordance with an embodiment.

FIG. 7 illustrates a method 700 of assembling a high voltage transformer arrangement in a high voltage tank assembly in accordance with an embodiment. The method 700 includes arranging a first core at a base portion of the high voltage assembly at block 702. A secondary winding is provided by arranging the winding on the first core at block 704. A molded component is arranged covering the first core for positioning the first core at the base portion of the high voltage tank assembly. The molded component is connected to the base portion of the high voltage tank using one or more fastening members.

In an embodiment an opening if provided at the base portion of the high voltage tank assembly. The opening facilitates in exposing a portion of the first core out from the high voltage tank assembly. At block 706, a second core is arranged outside of the high voltage tank assembly at predefined distance from the first core. The second core may be positioned with respect to the exposed portion of the first core. A primary winding is provided on the second core at block 708. In another embodiment an isolation layer is provided between the first core and the base portion of the high voltage tank assembly. The isolation layer is positioned proximal to the opening or covering the opening. In this case the isolation layer is exposed through the opening. The second core is arranged at the predefined distance from the isolation layer exposed out through the opening.

The second core and the primary winding transfers current received from an external power source to the first core and the secondary winding for supplying power to the high voltage tank assembly as shown in block 708.

Although the method 700 of assembling a high voltage transformer arrangement in a high voltage tank assembly in accordance with another embodiment are explained with reference to the flow chart of FIG. 7, other methods of implementing the method can be employed. For example, the order of execution of each method steps may be changed, and/or some of the method steps described may be changed, eliminated, divide or combined. Further the method steps may be sequentially or simultaneously executed for assembling a high voltage transformer arrangement in a high voltage tank assembly in accordance with another embodiment.

This written description uses examples to disclose the invention, including the best mode, and also to enable any person skilled in the art to practice the invention, including making and using any computing system or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What we claim is:

1. A high voltage transformer arrangement for supplying power to a high voltage tank assembly comprising:
   - a first core arranged in the high voltage tank assembly, wherein a portion of the first core is exposed out from the high voltage tank assembly;
   - a secondary winding configured on the first core;
   - a second core positioned outside of the high voltage tank assembly and at a predefined distance from the first core; and a primary winding configured on the second core, wherein the second core and the primary winding transfers current received from an external power source to the first core and secondary winding for supplying power to the high voltage tank assembly.

2. The high voltage transformer arrangement of claim 1, wherein the first core and the second core are a magnetic core.

3. The high voltage transformer arrangement of claim 1, wherein the primary winding and the secondary winding are in the form of printed circuit boards (PCB).

4. The high voltage transformer arrangement of claim 1, wherein the second core is positioned at the predefined distance from the portion of the first core exposed out from the high voltage tank assembly.

5. A high voltage transformer arrangement for supplying power to a high voltage tank assembly comprising:

a first core arranged in the high voltage tank assembly;

a secondary winding configured on the first core;

a second core positioned outside of the high voltage tank assembly and at a predefined distance from the first core;

a primary winding configured on the second core, wherein the second core and the primary winding transfers current received from an external power source to the first core and secondary winding for supplying power to the high voltage tank assembly; and a molded component configured to cover the first core for positioning the first core at a base portion of the high voltage tank assembly.

6. The high voltage transformer arrangement of claim 5, wherein the molded component is composed of a molding material.

7. The high voltage transformer arrangement of claim 6, wherein the molded component is connected to the base portion of the high voltage tank assembly using one or more fastening members.

8. The high voltage transformer arrangement of claim 5 further comprises an isolation layer positioned between the first core and the base portion of the high voltage tank assembly.

9. A high voltage tank assembly for generating power, wherein the high voltage tank assembly comprises:

at least one high voltage transformer arrangement, wherein at least one of said at least one high voltage transformer arrangement comprises:

a first core arranged in the high voltage tank assembly, wherein a portion of the first core is exposed out from the high voltage tank assembly;

a secondary winding configured on the first core;

a second core positioned outside of the high voltage tank assembly and at a predefined distance from the first core; and a primary winding configured on the second core, wherein the second core and the primary winding transfers current received from an external power source to the first core and secondary winding for supplying power to the high voltage tank assembly.

10. The high voltage tank assembly of claim 9, wherein the first core and the second core are a magnetic core.

11. The high voltage tank assembly of claim 9, wherein the primary winding and the secondary winding are in the form of printed circuit boards (PCB).

12. The high voltage tank assembly of claim 9, wherein the second core is positioned at the predefined distance from the portion of the first core exposed out from the high voltage tank assembly.

13. The high voltage tank assembly of claim 9 further comprises a molded component configured to cover the first core for positioning the first core at a base portion of the high voltage tank assembly, wherein the molded component is connected to the base portion of the high voltage tank assembly using one or more fastening members.

14. A high voltage tank assembly for generating power, wherein the high voltage tank assembly comprises:

at least one high voltage transformer arrangement, wherein at least one of said at least one high voltage transformer arrangement comprises:

a first core arranged in the high voltage tank assembly;

a secondary winding configured on the first core;

a second core positioned outside of the high voltage tank assembly and at a predefined distance from the first core;

a primary winding configured on the second core, wherein the second core and the primary winding transfers current received from an external power source to the first core and secondary winding for supplying power to the high voltage tank assembly; and an isolation layer positioned between the first core and the base portion of the high voltage tank assembly.

* * * * *